US005207720A

United States Patent [19]

Shepherd

[11] Patent Number: 5,207,720

[45] Date of Patent: May 4, 1993

[54] HOCKEY PUCK DEVICE

[75] Inventor: Charles G. Shepherd, Oakville, Canada

[73] Assignee: Fortron International Inc., Hamilton, Canada

[21] Appl. No.: 857,005

[22] Filed: Mar. 25, 1992

[30] Foreign Application Priority Data

Feb. 12, 1992 [CA] Canada ..... 2061075

[51] Int. Cl.[5] ..... A63B 71/06

[52] U.S. Cl. ..... 273/128 R; 273/57.2

[58] Field of Search ..... 273/128 R, 128 CS, 128 A, 273/57.2

[56] References Cited

FOREIGN PATENT DOCUMENTS 917686 12/1972 Canada .

71710 3/1970 German Democratic Rep. ..... 273/128 R

*Primary Examiner*—V. Millin
*Assistant Examiner*—Raleigh W. Chin
*Attorney, Agent, or Firm*—Rogers & Scott

[57] ABSTRACT

A practice ice hockey puck is provided for indicating, in relative terms, the energy of impact when the puck is driven into a solid object. The puck has a cylindrical case extending about a central axis and defining an axially extending well containing a housing which in turn contains an indicator arranged to move angularly against frictional restraint. A driver is coupled to the indicator so that on impact, the energy in the driver is transferred to the indicator to move the indicator angularly relative to the housing against the frictional restraint. The degree of angular movement of the indicator relative to the housing is recorded on a scale thereby showing the user in relative terms the energy of impact.

9 Claims, 2 Drawing Sheets

HOCKEY PUCK DEVICE

This invention relates to the game of ice hockey and more particularly to a practice puck having a structure for indicating, in relative terms, the energy of impact when the puck hits a solid structure such as a wall.

The game of ice hockey demands a combination of skills including speed skating with or without the puck, "handling" a puck from all directions using a hockey stick, firing or shooting the puck using a variety of techniques, and maintaining balance while engaging in passing plays and being involved in impacts with opposing players. One of the attributes inherent in these skills is the ability to shoot the puck with power so that the energy in the shot is sufficient to propel the puck at a velocity which makes it difficult for the opposing goalkeeper to stop the shot.

Players practice shooting in many ways but the results are very subjective. It is clearly desirable to have some comparative way of checking to see how a shot made in a particular manner compares with a second shot made in the same manner. This would allow the player to compare his shot with that of a team mate or to simply compare his own results when experimenting with different hand grips, foot positions, etc.

At least one attempt has been made to produce a hockey puck which carried a crude form of indicator to register the results of shooting the puck against a wall. A structure is shown in Canadian Patent No. 917,686. Although this practice puck had some success, it was not sufficiently reliable.

The present invention is intended to overcome the problems of providing a practice puck which indicates the energy in a shot and which is reliable and sufficiently robust to satisfy the user's requirements for repetitive use.

Accordingly, in one of its aspects, the invention provides a practice ice hockey puck for indicating, in relative terms, the energy of impact when the puck is driven into a solid object. The puck has a cylindrical case extending about a central axis and defining an axially extending well containing a housing which in turn contains an indicator arranged to move angularly against frictional restraint. A driver is coupled to the indicator so that on impact, the energy in the driver is transferred to the indicator to move the indicator angularly relative to the housing against the frictional restraint. The degree of angular movement of the indicator relative to the housing is recorded on a scale thereby showing the user in relative terms the energy of impact.

This and other aspects of the invention will be better understood with reference to the following description taken in combination with drawings, in which.

Figure 1:
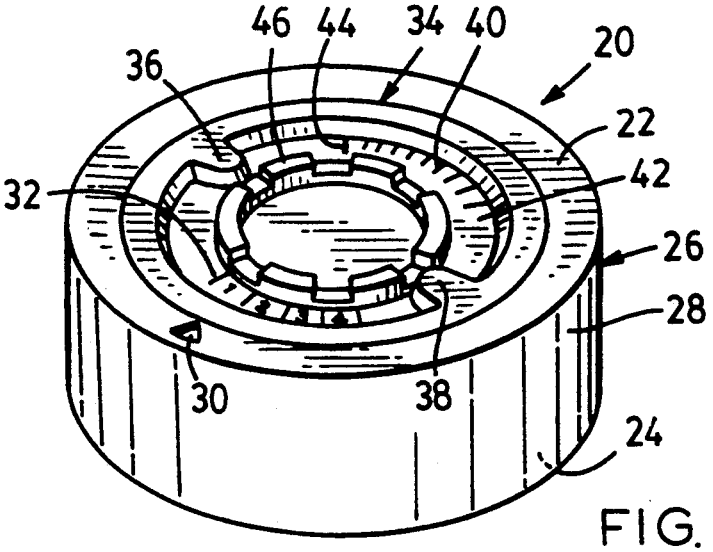
FIG. 1 is a perspective view from the top of a preferred embodiment of a practice puck according to the invention.

Reference is first made to FIG. 1 which shows a practice puck designated generally by the numberal 20. For the purposes of this description, the puck will have a top 22 and bottom 24 on a case 26. A side surface 28 is cylindrical about a central axis passing vertically through the centre of the puck and extends between the top 22 and bottom 24. As can be seen on the top, a triangular depression 30 is provided as an indicator for a scale 32 which can be moved relative to the indicator 30 by rotating an insert designated generally by the numeral 34. This movement of the insert 34 relative to the case 26 of the puck is facilitated by a pair of opposed shoulders 36, 38 and sets the degree of sensitivity according to scale 32 as will be described. A further scale 40 is also provided on an indicator 42 which is moveable relative to a mark 44 on a transparent part of the insert. This latter scale indicates in relative terms how much energy has been absorbed on impact. A castellated inner ring 46 permits the user to return the scale 40 back to zero relative to mark 44 ready for another shot as will be described in detail.

For the moment it is sufficient to understand that there are two adjustments to the puck. First of all, scale 32 is used to select the degree of sensitivity, and secondly the reading after shooting is found on scale 40 relative to mark 44. The scale 32 would be moved to one of the larger numbers for players with harder shots and to lower numbers for children.

Figure 2:
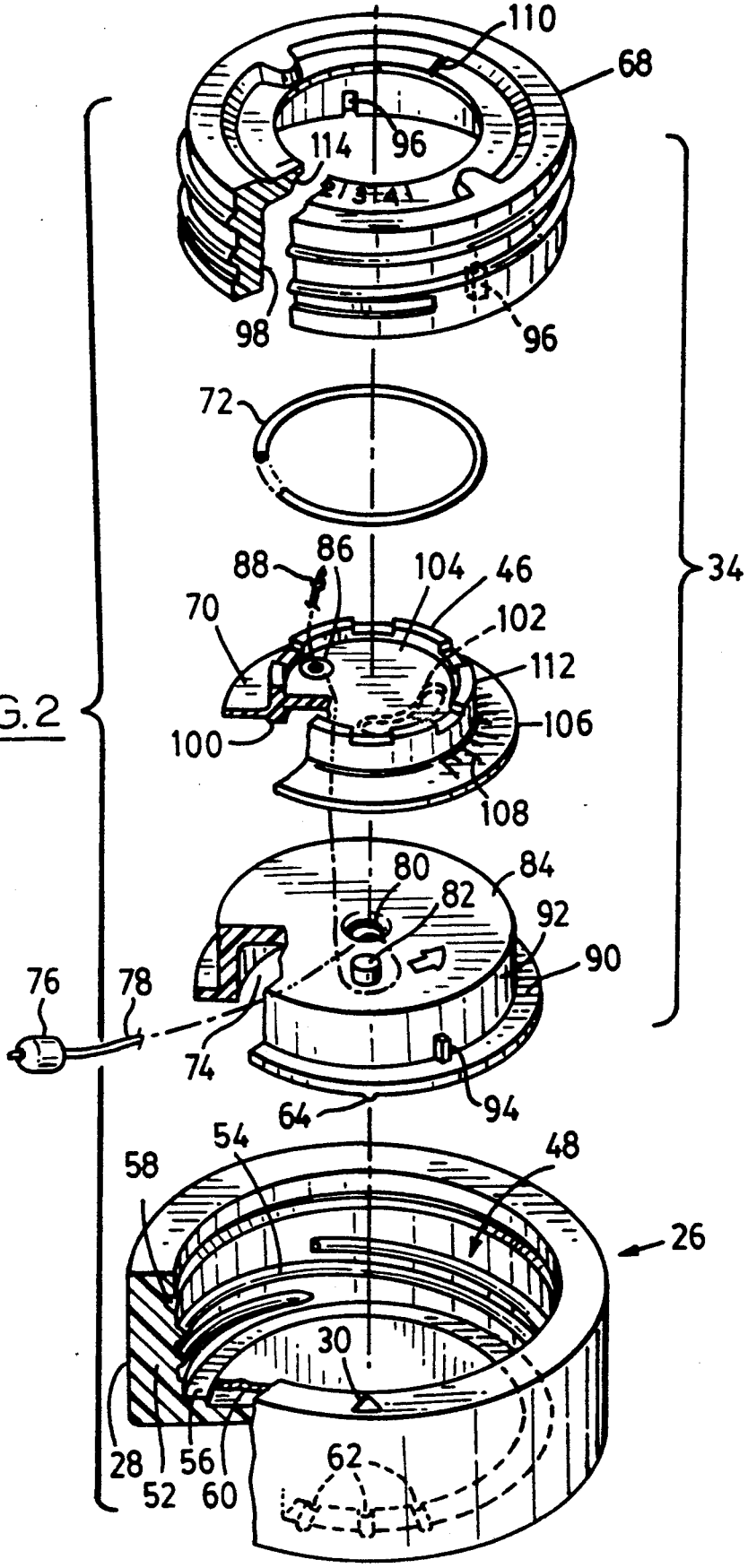
FIG. 2 is an exploded perspective view of the puck showing the essential parts and their relationships.

Reference is next made to FIG. 2 which shows the case 26 and the various parts exploded upwardly out of the case. The insert 34 (FIG. 1) is made up of all of the parts out of the case and the description will be completed starting with the case and working upwardly with reference to FIG. 2. As seen at the foot of FIG. 2, the case defines a well 48 having a bottom wall 50 and a side wall 52 which at its outer surface defines the side surface 28 and on its inner surface defines a dead-ended screw thread 54. The screw thread extends upwardly from an annular surface 56 and terminates short of a radial depression 58 which extends outwardly around the well 48.

The bottom of the well 48 is recessed with respect to the annular surface 56 to define a depression to contain a metal disk 60 which is proportioned to make up the weight of the puck to a standard puck weight.

Also seen in the case 26, and formed in the annular surface 56 at the bottom of the well 48, is a series of radial depressions 62 which are spaced apart equally and correspond to the numbers in the scale 32 seen in FIG. 1. These are depressions to locate a raised detent 64 in the insert 34 as will be described.

Figure 3:
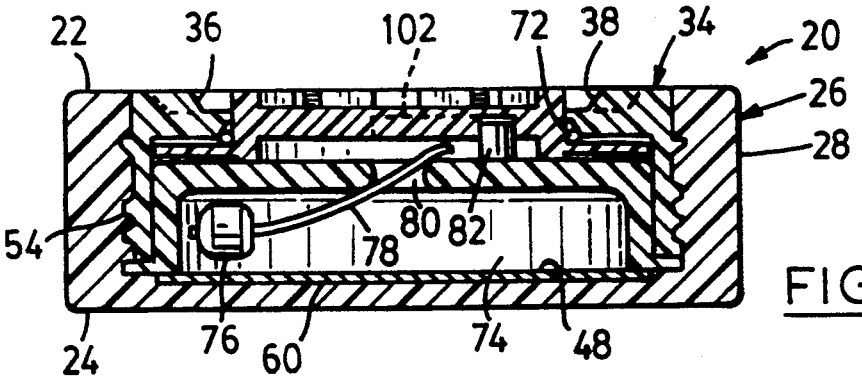
FIG. 3 is a sectional view on line 3—3 of FIG. 1.
Figure 4:
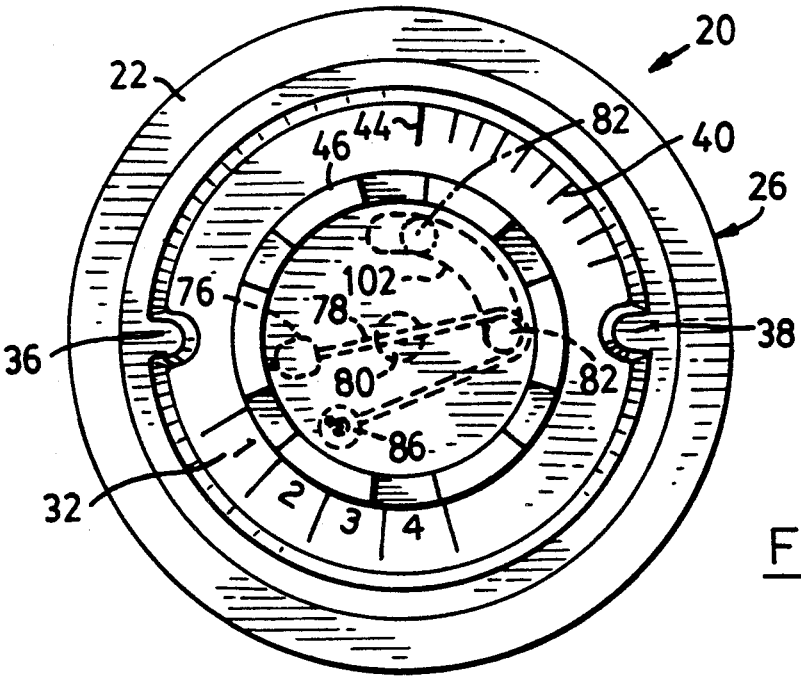
FIG. 4 is a top view of the puck with hidden detail shown in broken outline.

The insert 34 is made up essentially of an inner part 66 of a housing which also includes an outer part 68. When these parts are assembled, as seen in FIG. 3, they contain an indicator 70 and a friction ring 72 which is preferably compressible. Also, the inner part 66 combines with the case 26 to define a cavity 74 and in this cavity is located a weight 76 forming part of a driver for moving the indicator 70 angularly with respect to the housing. The driver also includes a string 78 which is shown diagrammatically (see also FIGS. 3 and 4) to pass through a central opening 80 and then to do a U-turn about a post 82 formed on the exposed surface of an intermediate wall 84. As best seen in FIG. 4, the post is remote from the central axis of the puck and the string continues from there to an anchor point 86 in the indicator 70 and is retained with a simple knot 88.

Turning to the housing inner part 66, it will be seen in FIGS. 2 and 3 that this part is a generally top-hat shape having a rim 90 and a side wall 92 between the rim and the intermediate wall 84. Three keys 94, (one of which is seen) are molded into the wall 92 near the rim 90 for engaging slots 96 seen as part of the housing outer part 68. The slots are formed in an inner surface 98 of part 68 and this surface is a sliding fit on the wall 92 of the inner part 66. As a result, when the housing is assembled, axial movement between the parts 66, 68 is possible but angular movement is prevented.

The indicator 70 has a bearing surface 100 for engagement with the intermediate wall 84 and an arcuate depression 102 in the underside of a transverse wall 104 to accommodate the post 82. Clearly the arrangement is such that the angular motion of the indicator 70 relative to the housing is limited by engagement of the post at the ends of the arcuate slot 102. This movement between first and second positions will be described in more detail later.

It can also be seen in FIG. 2 that the indicator 70 includes a flange 106 carrying a scale 108. This is to combine with a notch or mark 110 in the transparent outer part 68 of the housing to show relative movement for reasons which will be explained. For the moment it is sufficient to be reminded that this scale is intended to indicate the energy in the shot.

The friction ring 72 is positioned over a cylindrical portion 112 of the indicator 70 so that it comes into contact with the flange 106 and is a close fit around the cylindrical portion 112. As a result on assembly, and as seen in FIG. 3, the ring 72 is trapped between the flange 106 on the indicator 70 and an inclined surface 114 (FIG. 2) on the outer part 68. When the user grips the shoulders 36, 38 to rotate the insert so that detent 64 locates a selected one of the depressions 62, the result is that the outer part 68 turns in the screw thread 54 moving it axially and changing the compressive force on the friction ring 72. This results in varying the force necessary to rotate the indicator 70. Consequently, the movement of the indicator will vary for a given impact depending upon the selected position on the scale 32.

The operation of the driver will now be described with reference to FIGS. 2 and 3. As better seen in FIG. 3, the weight 76 is constrained by the string 78 in the cavity 74. The string is fed through the central opening 80 so that the weight can move within the cavity relative to the central opening. As seen in FIG. 4, the string extends about the post 82 in a U-shaped configuration terminating at the anchor point 86 in the indicator 70. Initially, the scale 108 to set to zero ready for impact. This provides the minimum length of string within the cavity 74. When the puck is struck by the hockey stick, the weight will move relative to the puck due to the acceleration of the puck and create a reading on scale 108. This is because the weight will tend to be left behind. On impact with a wall or the like, the weight will move further across the cavity 74 and its energy will be lost to the string which transmits the energy to rotate the indicator 70 against the frictional resistance caused by the ring 72. Clearly, the more resistance the less the indicator will turn.

It will be seen in FIG. 4 that the arrangement around the post 82 is such that there is a force applied to the indicator remote from the axis so that it will turn around the axis under the influence of this force. Although the action will not be entirely linear, the scale is intended to provide relative results and not absolute readings. Consequently the scale does not have to represent energy absorption in accurate terms although it could be calibrated.

The puck can be assembled in a number of ways. Possibly the most convenient is to make a sub-assembly of the inner part 66, the driver and the indicator. With the string 78 engaged in the weight 76, the string is fed through the central opening 80, about the post 82, and upwardly into the anchor 86. The post is engaged in the arcuate depression 102 and with the indicator representing the zero position, the weight is located somewhere near the central opening 80 and the knot 88 is engaged. The weight must be given room to move towards the wall of the cavity 74 in order that it will not impact on the wall before all of its energy is transferred to rotating the indicator 70. With this sub-assembly, the friction ring 72 is applied to the cylindrical portion 112 of the indicator 70 and the outer part 68 of the housing is slipped over the inner part to locate on the keys 94. It was not mentioned previously, but these keys are configured and sized so that there is only one way that these parts can be assembled to ensure that they are assembled correctly. The sub-assembly now consists of the insert 34 and it can be engaged in the case 26 by sliding it in a preferred location and rotating it to bring it into full engagement. It is also anticipated that with a proper selection of materials it will be possible to push the insert 34 into the case where it will snap into engagement with the threads.

In the preferred embodiment the case 26 is of an injected moulded elastomer sold under the trade mark VYRAM, a proprietary product of Monsanto. The material is selected to have a Durometer hardness of 70 on the Shore A scale. Inner and outer parts 66, 68, and the indicator 70 are made from polycarbonate and the friction ring 72 is Neoprene. The plate 60 is galvanized cold rolled steel and the weight 76 is brass. The string 78 connecting the weight is of a braided line of the type used by fishermen and has a 40 pound test strength.

In use it is anticipated that the most consistent results will be obtained when the puck is fired so that it goes through the air in a horizontal arrangement, i.e. with the central axis essentially vertical. The puck will then impact a wall or other vertical structure and the energy of impact will be transferred to the indicator 70 as described previously. However if the puck turns over and over in the air, or is otherwise made to deviate from this path, the freedom of the weight in the cavity 74 is such that a reading will still result. The readings will also be affected by the form of impact and the material of the target. It is possible that the impact will be a glancing blow as opposed to a direct hit, the puck could have a very high spin and these could be combined with other variables. Further, if the target material will "give" in any way, either due to being light or to it having a deformable surface, then these characteristics will also affect the result. It will also be recognized that a so called "wrist shot" which smoothly accelerates the puck will have a different initial affect on the puck from a sudden shot, commonly called a "slap shot". In the slap shot the puck is hit more like a golf ball than it is with a wrist shot.

Nevertheless, because all hockey players practice diligently to develop specific shot skills which are consistent and repeatable, this device assists the players to refine and evaluate their various techniques by providing energy impact information not otherwise available. For comparison purposes, it is clearly preferable if the shot can be done in the same way each time to give more meaning to the comparison of the results, but in any event comparison of any kind is beneficial.

It will be evident from the foregoing description and drawings that variations can be made to the design of the puck. Such variations are within the scope of the invention as claimed.

I claim:

1. A practice ice hockey puck for indicating in relative terms the energy of impact when the puck is driven into a solid object, the puck comprising:

a shallow cylindrical case extending about a central axis and defining an axially extending well and a floor at the bottom of the well;

a housing inside the well, the housing defining a central opening and a post remote from said axis;

means retaining the housing in the well;

an indicator contained in the housing in frictional engagement with the housing, the indicator being moveable angularly between first and second positions about said axis;

a driver coupled to the indicator, the driver comprising a weight contained inside the housing and a string attached to the weight and extending through the central opening and about the post, the string being anchored to the indicator at a point spaced from said axis so that in plan view the string lies in a generally U-shaped configuration and on impact between the puck and an object, kinetic energy in the weight is transferred by the string to the indicator thereby moving the indicator angularly relative to the housing away from said first position and towards said second position against the resistance of said frictional engagement; and scale means coupled to the indicator and housing to record the degree of angular movement of the indicator to show the user in relative terms the energy of impact.

2. A puck as claimed in claim 1 in which the housing combines with the case to define a cavity and the housing includes an intermediate radial wall having a central opening, said weight being contained in the cavity.

3. A puck as claimed in claim 2 in which the indicator defines a short annular slot containing part of the post so that first and second positions are defined by the range of movement permitted by the post engaging the ends of the slot.

4. A practice ice hockey puck for indicating in relative terms the energy of impact when the puck is driven into a solid object, the puck comprising:

a shallow cylindrical case extending about a central axis and defining an axially extending well and a floor at the bottom of the well;

an insert threaded in the well for rotation between a first limit where the insert is fully engaged, and a second limit where the insert is not fully engaged, the insert moving axially as it is moved between the first and second limits, the insert having a housing made up of an outer part having threads to make said threaded engagement in the well, an inner part trapped between the outer part and the floor of the case, key means in engagement with the inner and outer parts to prevent relative angular motion between these parts whereby the housing rotates as an entity within the well of the case, an intermediate wall on the inner part of the housing carrying an axially extending post positioned remote from said axis, an indicator on the intermediate wall for movement angularly, scale means coupled to the housing and the indicator to show relative angular movement of the indicator and the housing, the scale means being constrained frictionally be axial loading as the housing outer part is turned relative to the case to move the housing towards said first limit, and a driver having a weight inside the cavity and a string extending from the weight, through said aperture, about the post in a U-shaped bend, and terminating at the indicator; and detent means on the insert and case to selectively position the insert in the case with the housing being in selected positions between said first and second limits to vary the frictional restraint on the indicator so that on impact, the kinetic energy in the driver will move the indicator relative to the scale by an amount dependent on the angular position of the insert in the case.

5. A practice hockey puck comprising:

a shallow cylindrical case disposed about an axis and defining a well about said axis;

a housing constrained to remain in the well and having inner and outer parts;

an indicator contained in the housing between said inner and outer parts for movement angularly about said axis between limits, the housing applying a frictional force to the indicator;

scale means attached both to the housing and to the indicator to give a visual indication of the position of the indicator relative to the housing; and a driver coupled to the indicator and responsive to impact to move the indicator angularly about said axis against frictional resistance and to thereby demonstrate, in relative terms, the energy of impact.

6. A puck as claimed in claim 5 in which the housing is threadably engaged in the case such that rotation of the housing in the case changes longitudinal compression on the indicator to selectively adjust the degree of sensitivity of the indicator for use by different levels of players.

7. A puck as claimed in claim 6 in which the housing and case combine to define detent means for locating the housing relative to the case in a selected location for a selected said degree of sensitivity.

8. A puck as claimed in claim 5 in which the driver includes a weight and a string.

9. A puck as claimed in claim 5 in which the inner part defines a cavity, an intermediate transverse wall having a central opening and a post on the transverse wall spaced from the opening, and in which the indicator has an anchor point offset from said axis, and in which the driver includes a weight free to move in the cavity, and a string extending from the weight, through the opening, about the post in a U-shaped configuration and terminating at the anchor point.

* * * * *